US005422795A

United States Patent [19]

Liu

[11] Patent Number: 5,422,795

[45] Date of Patent: Jun. 6, 1995

[54] LIGHTING FIXTURE WITH AIR CLEANING AND VENTILATING MEANS

[75] Inventor: Ming-Jen Liu, Taipei, Taiwan, Prov. of China

[73] Assignee: Wen-Chin Liu, Taoyuan, Taiwan, Prov. of China

[21] Appl. No.: 230,154

[22] Filed: Apr. 19, 1994

[51] Int. Cl.[6] ..... F21V 33/00

[52] U.S. Cl. ..... 362/96; 362/294; 415/5; 55/471; 55/473

[58] Field of Search ..... 362/96, 149, 294, 345, 362/253, 234; 415/5; 55/471, 473

[56] References Cited

U.S. PATENT DOCUMENTS 2,115,883 5/1938 Sher ..... 362/96
2,258,731 10/1941 Blumenthal ..... 362/96
3,860,404 1/1975 Jochimski ..... 55/473
3,890,126 6/1975 Joseph ..... 55/473
4,926,293 5/1990 Saba ..... 362/96

*Primary Examiner*—James C. Yeung
*Attorney, Agent, or Firm*—Bacon & Thomas

[57] ABSTRACT

A lighting fixture includes a lamp shade having a lamp holder to hold a lamp bulb on the inside and a plurality of hooks around the lamp holder, an air filter fastened to the hooks around the lamp holder, an electrical fan mounted on the lamp shade at the top and controlled to cause currents of air blowing through vent holes on the top of the lamp shade or to draw currents of air out of the lamp shade, and a covered on the electrical fan at the top and having a wire hole for passing electrical wires.

2 Claims, 2 Drawing Sheets

LIGHTING FIXTURE WITH AIR CLEANING AND VENTILATING MEANS

BACKGROUND OF THE INVENTION

The present invention relates to lighting fixtures, and more particularly to a lighting fixture which includes an air filter for cleaning the air and an electrical fan for circulating fresh air.

A variety of lighting fixtures have been disclosed, and have appeared on the market. These lighting fixtures may be used in different situations or locations, they simply give light for illumination without providing other functions.

SUMMARY OF THE INVENTION

The principal object of the present invention is to provide a lighting fixture which has an air filter for cleaning the air and an electrical fan for circulating fresh air. Another object of the present invention is to provide a lighting fixture having air cleaning and ventilating means which does not occupy much installation space. Still another object of the present invention is to provide a lighting fixture having air cleaning and ventilating means which prolongs the service life of the lamp. Still another object of the present invention is to provide a lighting fixture having air cleaning and ventilating means which is detachable for easy washing.

According to the preferred embodiment of the present invention, the lighting fixture comprises a lamp shade having a lamp holder for holding a lamp bulb on the inside thereof and a plurality of hooks around the lamp holder, an air filter fastened to the hooks around the lamp holder, an electrical fan mounted on the lamp shade at the top thereof and controlled to cause currents of air blowing through vent holes on the top of the lamp shade or to draw currents of air out of the lamp shade, and a cover on the top of the electrical fan having a wire hole for passing the electrical wires.

DETAILED DESCRIPTION OF THE PREFERRED EMBODIMENT

Figure 1:
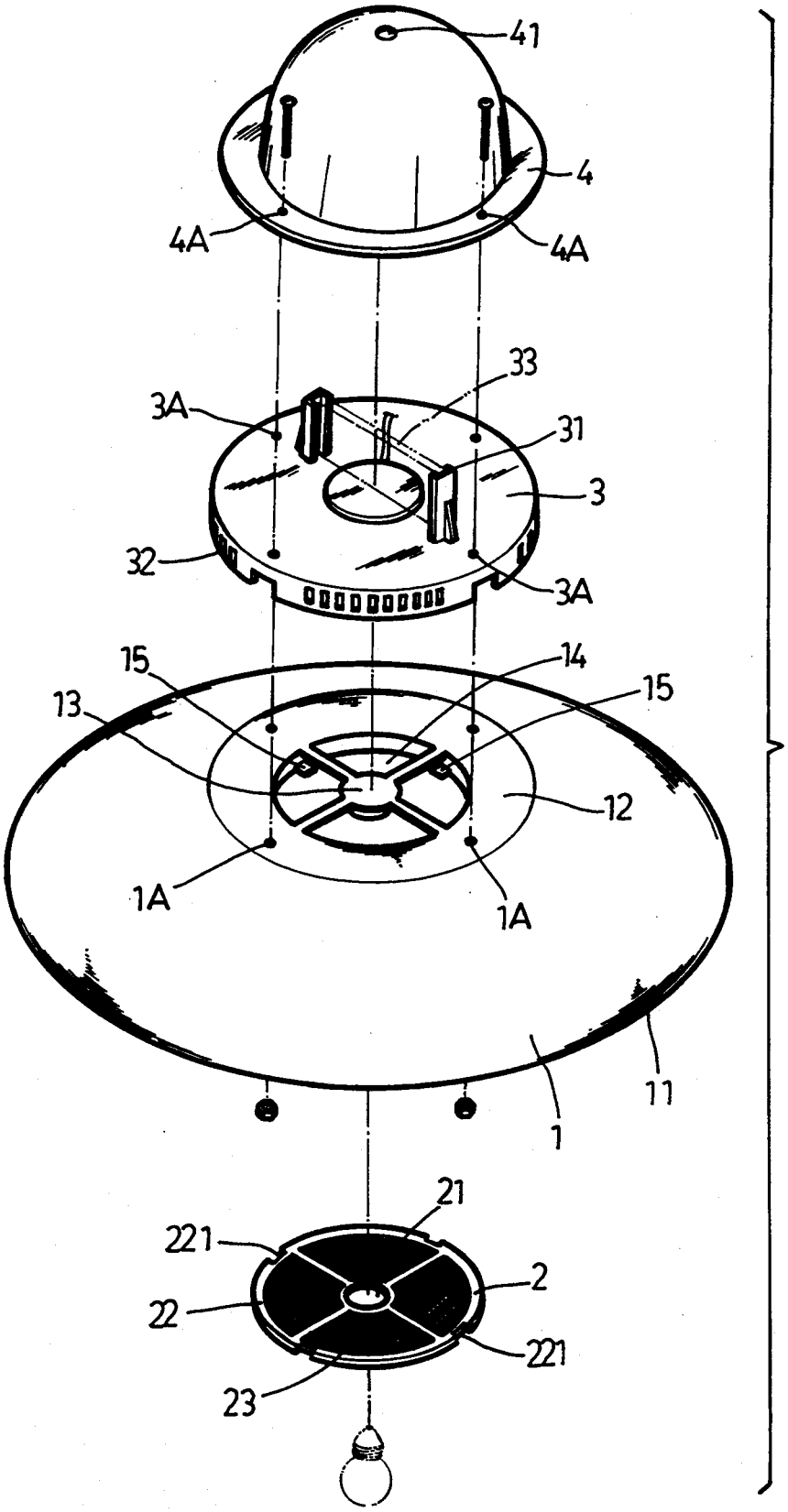
FIG. 1 is an exploded view of a lighting fixture according to the preferred embodiment of the present invention.
Figure 2:
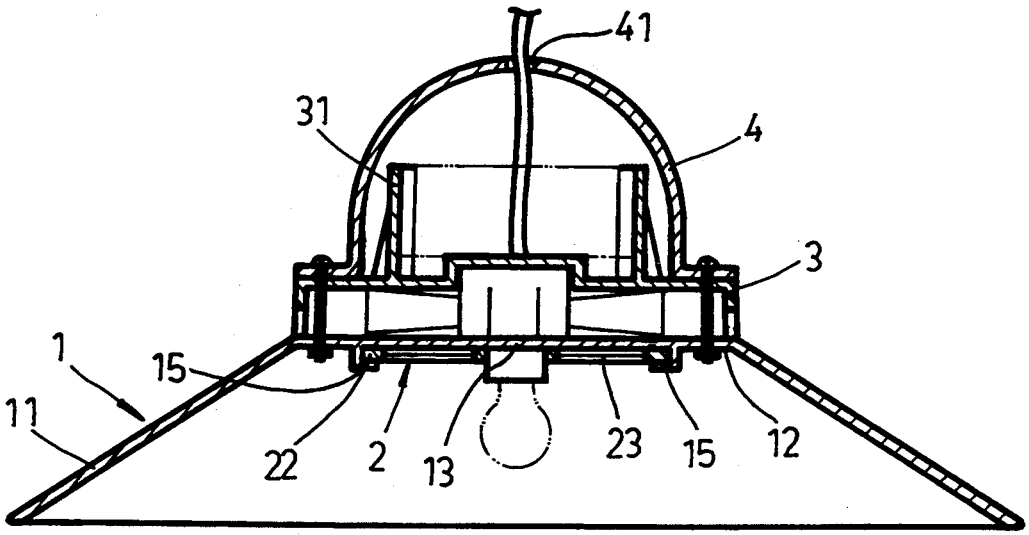
FIG. 2 is an elevational view in section of the lighting fixture of FIG. 1.

Referring to FIGS. 1 and 2, a lighting fixture in accordance with the preferred embodiment of the present invention is generally comprised of a lamp shade 1, an air filter 2, an electrical fan 3, and a cover 4.

The lamp shade 1 is made of conical shape having a peripheral flange 11 around the border of the broadest bottom end thereof, a flat top wall 12, a lamp holder 13 in the center of the flat top wall 12 to hold a lamp bulb, air vents 14 spaced around the lamp holder 13 within the flat top wall 12, and a plurality of bottom hooks 15 projecting downwardly from the flat top wall 12 at the bottom thereof (see FIG. 2). The air filter 2 is fastened to the inside of the lamp shade 1 and has a center hole 21 in the center of a circular, meshed filter plate 23 thereof, a plurality of notches 221 spaced around the rim 22 of the meshed filter plate 23 corresponding to the hooks 15 on the lamp shade 1. The electrical fan 3 is made of circular shape for fitting over the flat top wall 12 of the lamp shade 1 and includes two upright mounts 31 at the top to hold a PC board (shown generally at 33), and a plurality of vent holes 32 around the border thereof. The PC board 33 controls the operation of the electrical fan causing it to provide currents of air to or draw off air from of the lamp shade 1. The cover 4 is fastened to the electrical fan 3 at the top, and includes a wire hole 41 for passing the lead wires from the PC board 33 on the electrical fan 3. A plurality of corresponding screws holes 4A,3A and 1A may be respectively provided on the cover 4, the electrical fan 3, and the flat top wall 12 of the lamp shade 1 so that the cover 4 and the electrical fan 3 and the lamp shade 1 can be fastened together by screws. The air filter 2 can be conveniently fastened to the lamp shade 1 by engaging the notches 221 on the rim 22 of the air filter 2 with the hooks 15 on the lamp shade 1 and then turning the air filter 2 in either direction, and thus retaining the air filter 2 in place by the hooks 15 (as shown in FIG. 2).

While only one embodiment of the present invention has been shown and described, it will be understood that various modifications and changes could be made without departing from the spirit and scope of the invention. For example, a negative ion generator may be installed in the output port of the electrical fan 3 to generate negative ions for purifying the air.

What is claimed is:

1. A lighting fixture comprising:

a) a lamp shade including a shade body, a flat top wall in the center of the shade body, a peripheral flange defining a border of the shade body, the peripheral flange being disposed at a lower elevation than the flat top wall, a lamp holder disposed in a center of the flat top wall for holding a lamp bulb inside the shade body, a plurality of air vents formed in the flat top wall and spaced around the lamp holder, a plurality of screw holes spaced around a border of the flat top wall, and a plurality of hooks projecting downwardly from a bottom of the flat top wall;

b) an air filter mounted inside the lamp shade around the lamp holder, the air filter including a circular meshed filter plate secured to the bottom hooks, the filter plate including a center hole for receiving the lamp holder, and a plurality of notches spaced around a rim thereof for engagement by the bottom hooks to secure the filter plate to the lamp shade;

c) an electrical fan secured to a top of the flat top wall, the electrical fan including two upright mounts at a top thereof for holding a control circuit board, a plurality of vent holes spaced around a periphery thereof, and a plurality of screw holes corresponding to the screw holes of the flat top wall for connecting the electrical fan to the lamp shade; and d) a cover secured to the top of the electrical fan, the cover including a wire hole for passing electrical wires of a control circuit board.

2. The lighting fixture of claim 1 wherein the cover further includes a plurality of screw holes corresponding to the screw holes of the flat top wall and the electrical fan for securing the cover, electrical fan and lamp shade together.

* * * * *